US006404401B2

(12) United States Patent
Gilbert et al.

(10) Patent No.: US 6,404,401 B2
(45) Date of Patent: Jun. 11, 2002

(54) METAMORPHIC PARALLEL PLATE ANTENNA

(75) Inventors: Roland A. Gilbert, Milford, NH (US); Jesse L. Butler, Moorpark, CA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 09/844,949

(22) Filed: Apr. 26, 2001

Related U.S. Application Data

(60) Provisional application No. 60/200,781, filed on Apr. 28, 2000.

(51) Int. Cl.[7] ..... H01Q 19/10

(52) U.S. Cl. ..... 343/780; 343/777; 343/834

(58) Field of Search ..... 343/780, 777, 343/833, 834, 761; H01Q 19/00, 19/10

(56) References Cited

U.S. PATENT DOCUMENTS 3,935,576 A * 1/1976 Pickles ..... 343/761
4,127,830 A 11/1978 Chalifour et al.
5,767,807 A * 6/1998 Pritchett ..... 343/834
5,815,119 A 9/1998 Helms et al.
5,815,122 A 9/1998 Nurnberger et al.
5,835,062 A 11/1998 Heckaman et al.
5,905,466 A 5/1999 Jha
RE36,506 E 1/2000 Dempsey et al.
6,337,668 B1 * 1/2002 Ito et al. ..... 343/833

OTHER PUBLICATIONS

PCT International Search Report dated Sep. 6, 2001 of International Application No. PCT/US01/13658 filed Apr. 27, 2001.

* cited by examiner

*Primary Examiner*—Michael C. Wimer
(74) *Attorney, Agent, or Firm*—Salzman & Levy

(57) ABSTRACT

The present invention provides a low-cost, steerable antenna formed with a dielectric medium separating a pair of conductive plates and a centrally located signal feed. Switches selectively interconnect the conductive plates through the dielectric medium in patterns, which determine the direction of operation of the antenna. The directionality of the antenna may be fixed or rapidly changed, depending upon the application.

23 Claims, 3 Drawing Sheets

METAMORPHIC PARALLEL PLATE ANTENNA

RELATED APPLICATION

This application claims priority from U.S. Provisional Patent Application Serial No. 60/200,781 filed Apr. 28, 2000.

FIELD OF THE INVENTION

The present invention relates to parallel plate antennas and, more particularly, to steerable, circular parallel plate antennas.

BACKGROUND OF THE INVENTION

Modern communications applications at millimeter band frequencies often require the use of high gain, directional antennas. Typically, directional antennas have narrow beamwidths which requires that the antenna be pointed directly at the communicating device or apparatus. When communicating in another direction, the antenna must be physically rotated to point in the new direction. In some dynamic situations, the antenna might require turning (i.e., rotating) at a faster rate than can be achieved mechanically. One antenna that has been used for these millimeter wave applications is the "pillbox" antenna, which derives its name from its size and shape, with the addition of a horn protruding on one side. Such antennas typically have parallel upper and lower conductive plates between which an electrode is positioned orthogonally with respect to the parallel plates. An arcuate rear reflector extends between the parallel plates and surrounds a significant part of the electrode, giving the antenna its "pillbox" shape. Opposite the rear reflector, the sides of a horn also extend between the parallel plates to collect and feed energy to and from the electrode.

Alternatively, phased arrays can position beams rapidly by adjusting the phase of the arrayed elements. However, many wireless communications applications today do not need any more gain than can be provided by a single antenna element. Consequently, relatively expensive, phased array systems are not necessary for these kinds of applications. The inventive antenna provides a means for rapidly steering the beam of a single element antenna electronically and/or optically.

It is therefore an object of the invention to provide a low-cost, compact steerable antenna for operation in k-band to w-band applications.

It is a further object of the invention to provide a low-cost, compact, steerable antenna that is steered electronically or optically.

It is another object of the invention to provide a low-cost, steerable antenna which may be co-located to provide both transmit and receive functions (i.e., full-duplex operation).

It is a still further object of the invention to provide a low-cost, steerable antenna which may be used to provide simultaneous multipoint communications.

It is yet another object of the invention to provide a low-cost, steerable antenna which may be fed either passively with a probe or actively with an embedded resonator.

SUMMARY OF THE INVENTION

In accordance with the present invention there is provided a low-cost, steerable antenna formed with a semiconductor dielectric medium located between two substantially parallel conductive plates. The plates may be selectively interconnected through the dielectric medium in different patterns defining different directions of operation for the antenna. In one form, photonic energy is used to activate the semiconductor medium to interconnect the plates and a pattern of openings in one or more of the plates act as optical ports for the application of that photonic energy. Activation of the exposed semiconductor with light causes a conductive region to be formed in the semiconductor, thereby connecting the plates with the shape and directionality of the desired antenna. By controlling the activation pattern, the directionality is controlled. The directionality may be fixed or rapidly changed depending upon the application.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Figure 1:
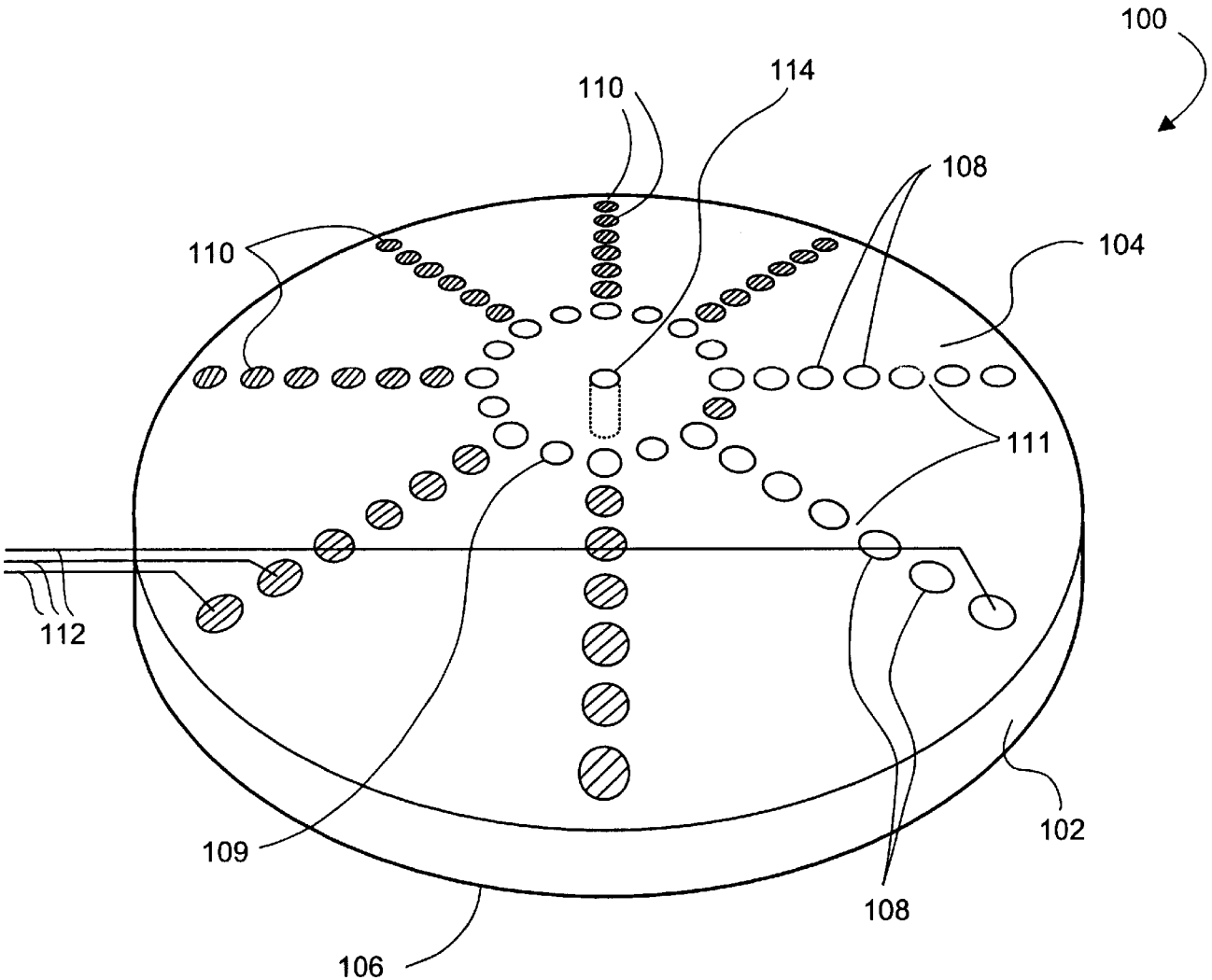
FIG. 1 is a perspective view of an antenna constructed in accordance with one embodiment of the present invention.
Figure 2:
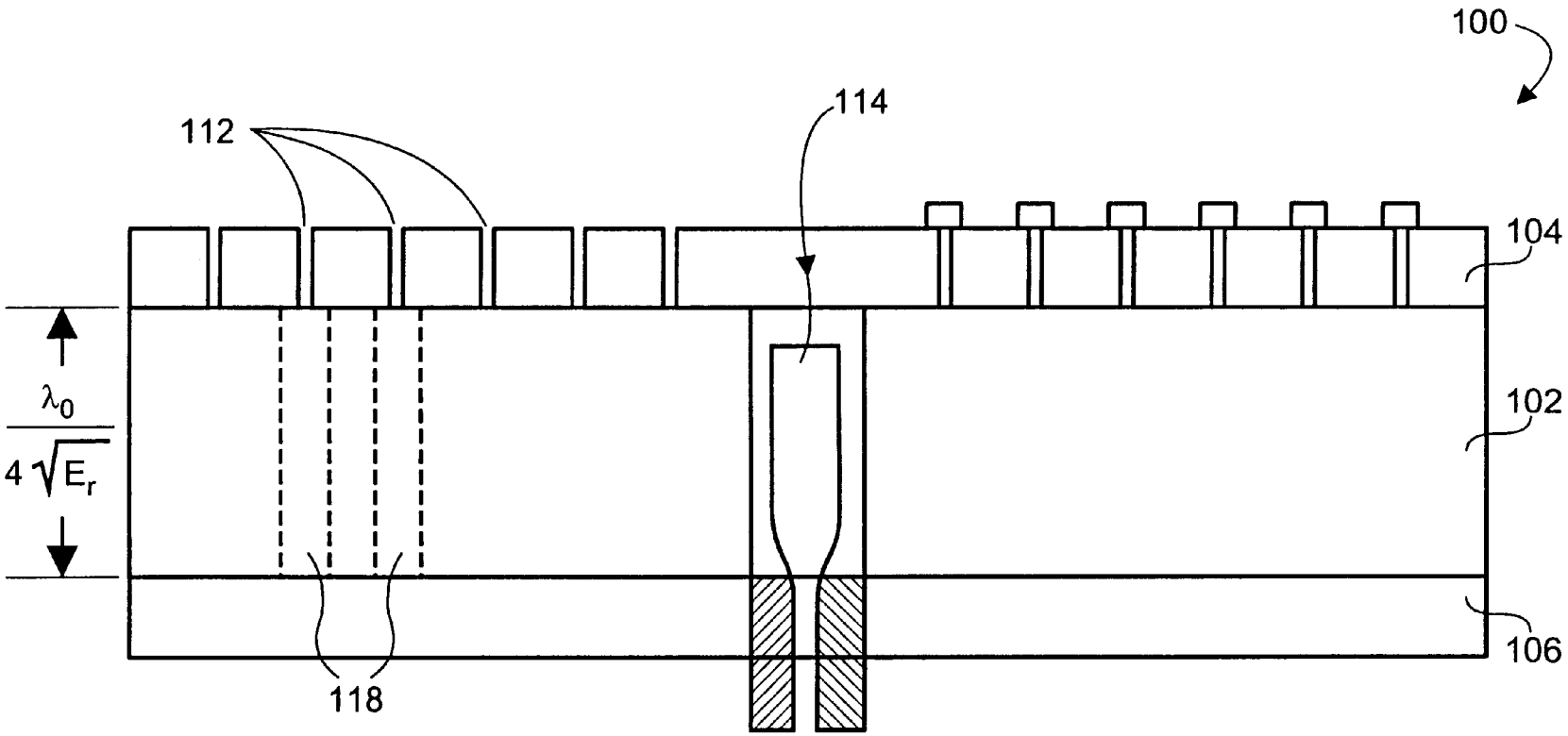
FIG. 2 is a cross-sectional view of the antenna shown in FIG. 1.

The present embodiment features a steerable, parallel plate antenna shown in FIGS. 1 and 2. Antenna 100 includes a pair of substantially parallel conductive plates 104 and 106 separated by a dielectric medium 102. Antenna 100 is nominally circular in shape and receives radio frequency (RF) energy through a central feed 114. The directionality or steering of the antenna 100 is controlled through a multiplicity of switching means located between the two conductive plates 104 and 106. These switching means are located along the pattern of openings or ports 108, 110 shown in the upper plate 104. Activation of selected groups of switch means creates conductive barriers 118 within the dielectric medium 102, which confines RF energy between the barriers to and from the feed 114.

In one embodiment the switching means are formed by using a dielectric semiconductor for the dielectric medium 102 and by coupling photonic energy into the semiconductor dielectric medium 102 through the openings 108, 110. This photonic energy causes the creation of conductive barriers 118 between the upper and lower parallel plates 104, 106, which conductive barriers 118 cause the channeling and reflection of RF energy located within the dielectric medium 102.

In one embodiment, a cylindrical section of semiconductor wafer forms dielectric medium 102. Semiconductor materials found satisfactory for this application are typically monolithic intrinsic silicon, gallium arsenide, indium phosphide, etc. High resistivity silicon (~5000 ohm-cm) is preferred with minority carrier lifetimes on the order of one millisecond. By doping the silicon, the lifetime can be shortened, thereby allowing for faster switching but with more signal loss in the substrate. A range of other materials are known to those skilled in the semiconductor arts which are suitable for use in this application.

The thickness of dielectric medium 102 is approximately one-fourth of the wavelength of the signal at which the antenna 100 is intended to operate. This thickness may also be used to adjust the impedance of the dielectric material to help match the impedance of feed 114 with the impedance of the transmission medium surrounding antenna 100 (typically air). As long as this distance remains less than one half of the wavelength for the intended functional bandwidth of the antenna 100, proper operation of antenna 100 will be enabled. Although the plates 104, 106 are shown as parallel some variation in their separation may occur in radial directions from the feed 114, to further gradually adjust the impedance of dielectric medium 102 and better match it to the surrounding transmission medium. Additional impedance matching material may also be used around antenna 100 depending upon the dielectric medium 102 and the surrounding transmission medium. Impedance matching is helpful in reducing reflection of RF energy back into a transmitting antenna and/or signal loss for received signals.

Conductive plates 104, 106 may take the form of thin metallized layers on the top and bottom surfaces of a semiconductor dielectric medium 102. Plates 104, 106 may be vacuum deposited, sputtered, plated or produced using any other method or technology known to those skilled in the semiconductor arts.

A pattern of holes or optical ports 108, 110 is etched in top metallized plate 104, exposing the dielectric medium 102. These ports 108, 110 are typically etched, but may also be formed in any manner known to those skilled in the semiconductor manufacturing arts. The surface of the exposed semiconductor is then passivated to maintain the lifetime of the material in the vicinity of the opening.

To complement conductive plates 104, 106 the pattern, spacing, size and shape of the optical ports 108, 110 define the remaining antenna reflectors and some of the antenna's electrical characteristics. Conductive plate 104 shows the optical ports 108, 110 arranged in a patter defining an antenna shape which may be pointed in different directions. The ports 108, 110 include an inner circle 109 of ports and a multiplicity of radial spokes 111. The basic antenna pattern produced by this embodiment is a pillbox with a round reflector, formed by most of inner circle 109, located around most of the feed 114 and a horn, formed by two adjacent radial spokes, extending from an open, or inactivated portion of the inner circle 109. This shape is exemplified by the unshaded ports 108, of which all but one of the ports in the inner circle would be illuminated and only two of the radial spokes would be illuminated.

Spacing or location of ports 108, 110 is dependent upon the intended frequency of operation for the antenna 100. As shown in FIG. 2, the conductive barriers 118 take the form of conductive columns and do not necessarily form a complete conductive wall across the plates 104, 106 between adjacent ports 108, 110. This limited application of photonic energy helps to save power consumption in the operation of antenna 100 but does not affect the performance of the antenna. So long as adjacent openings 108, 110 are located within one-half of a wavelength, the resulting conductive columns will be effective in forming the desired waveguide for RF energy. Preferably, openings 108, 110 are located approximately one-quarter wavelength apart at the intended frequency of operation for the antenna 100.

Although each of the ports 108, 110 is representationally shown as a equal diameter circle, the shape and size of openings 108, 110 may be varied between different openings to further enhance performance of the antenna 100. For example, openings located along the radial spokes 111 of the pattern may have varying sizes or shapes to further enhance impedance matching over the radial extent of the medium 102. For this purpose, openings further away from the central feed 114 along the spokes may be made smaller. Note that ports 108, 110 are substantially identical, but have been shown in a contrasting manner for purposes of a functional example described below: spots 108 representing photonically-illuminated spots and spots 110 representing non-illuminated spots.

As mentioned, photonic energy is controllably provided to the openings or ports 108, 110 in order to activate excess minority conductors within the semiconductor dielectric medium 102 and thereby form conductive barriers 118 within the semiconductor medium between the parallel plates 104, 106. This photonic energy may be delivered to the medium 102 by any suitable means. In one embodiment, the energy is delivered by optical fibers 112 to individual holes for openings 108, 110 from an optical source. Alternatively, individual laser diodes 113 may be located over each port 108, 110. Any other suitable delivery medium for photonic energy may also be applied to the present antenna 100. Further, LEDs might also be formed directly in the semiconductor dielectric medium 102 and receive activation energy through ports 108, 110.

In one embodiment, optical fibers 112 are attached to the exposed silicon 102 at all ports 108, 110. Activating light, typically laser illumination, may be supplied at a distal end on optical fibers 112 and conducted to dielectric medium 102 at etched ports 108, 110. Laser light in approximately the 1 $\mu$m wavelength range has been found satisfactory. The activating light source can be light emitting diodes (LEDs) or laser diodes. Between 10 mW and 25 mW of optical power is required to activate the conductive regions.

The radio frequency (RF) signal feed 114 is disposed at or near the center of dielectric medium 102. The shape and dimensions of signal feed 114 are dependent upon the impedances of the signal feed and the antenna 100 and may typically take the form of a probe, as shown, or a slot radiator, although any suitable element may be used.

In operation, antenna 100 has a signal of a predetermined radio frequency applied to feed 114. Selective illumination of ports 108 causes the semiconductor dielectric medium (FIG. 2) beneath ports 108 to become conductive and form conductive barriers 118 between the plates 104, 106. Conductive barriers 118 are reflective of RF energy so that barriers formed within the inner circle 109 of ports reflect RF energy to and from feed 114 while barriers 118 formed along spokes 111 of the pattern couple RF energy to and from the center circle. The predetermined directionality of the antenna 100 is dependent upon the spots 110 selected for illumination. By choosing different spots 110 for illumination, the directionality of antenna 100 may be changed. Moreover, by rapidly changing the selected spots 110, antenna 100 may be easily redirected or even continuously swept. The speed of switching is limited by the minority carrier lifetime within the bulk material. For silicon, this is about 100–1000 microseconds. While a transmission operation has been described for purposes of disclosure, the inventive antenna 100 is equally suited for use as a directional receiving antenna.

Figure 3:
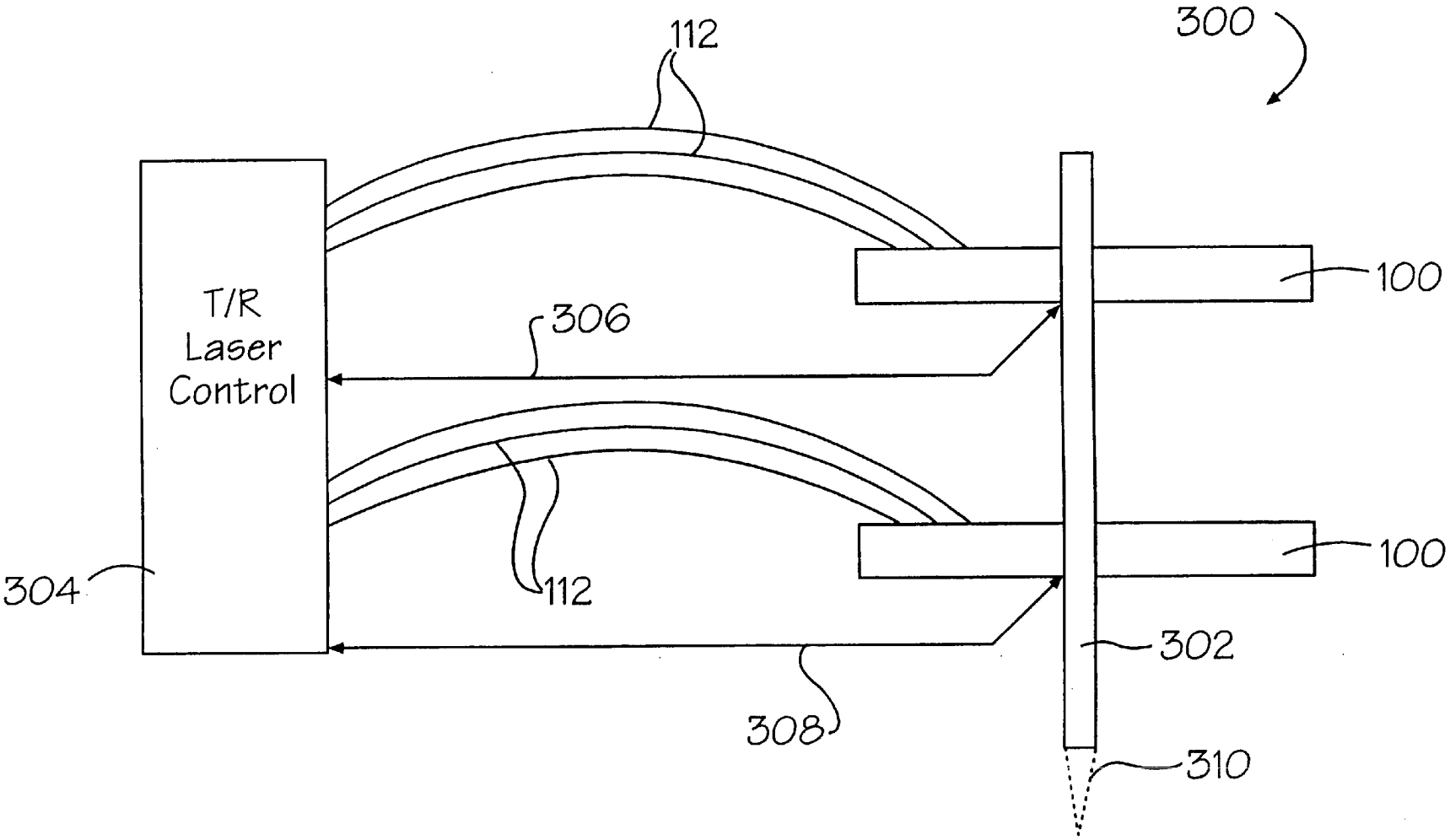
FIG. 3 is a schematic view showing a stacked pair of the antennas shown in FIG. 1.

Because the radiation pattern from antenna 100 is from the edge of silicon disk 102 at a region between illuminated spots 108, two or more antennas 100 may be stacked for simultaneous transmission and reception (full-duplex communications) or for transmission and/or reception at multiple frequencies. Referring now to FIG. 3, there is shown a schematic representation of such an arrangement, generally at reference number 300. A pair of the inventive antennas 100 is supported on a central support 302. Fiber optic waveguides or strands 112 connect antennas 100 and a transmitter/receiver/controller 304 and the upper and lower antennas 100, respectively. Support 302 could be configured to have a pedestal (not shown), a clamp (not shown), or even a pointed arrow 310 in which the antenna could be deployed in difficult to reach areas by a projectile launcher or even by dropping.

In alternate embodiments, more than two elements could be stacked to provide full duplex operation. This arrangement, however, would require a very complex central probe feed because one element is used for receive and the other for transmit. The probe would have to be that of a pipe within a pipe with the wider pipe penetrating only the first layer, and the next inside coax extending to the next level in the stack, etc. Isolation between the two antennas is important to minimize noise.

Another embodiment is an array. The feed probe just becomes a serial probe or wire with a connector below and above the wafer. The top connects to the bottom of the stacked element through an appropriate delay line.

In yet another embodiment as a transmitting antenna, the antenna could be fed by an active device such as an impatt diode resonator at the center of the antenna, instead of a probe. This would require that only a modulation signal and power be brought to the antenna.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A antenna having a controllable direction of operation, comprising:

a pair of substantially parallel conductive plates;

a semiconductor dielectric medium located between the conductive plates;

an RF feed located centrally to the conductive plates and the dielectric medium and adapted to intorduce RF energy between the conductive plates; and photonic source means for selectively activating different portions of the semiconductor dielectric medium to electrically interconnect the conductive plates in a plurality of patterns defining different directions of operation of the antenna.

2. The antenna of claim 1, wherein the dielectric medium has substantially parallel opposing surfaces, and further wherein the conductive plates are formed by metal deposited on the opposing surfaces.

3. The antenna of claim 2, wherein the semiconductor dielectric medium is shaped in a cylindrical section.

4. The antenna of claim 1, wherein one or more of the conductive plates includes optical ports located therethrough for allowing photonic energy to be provided to the semiconductor dielectric medium.

5. The antenna of claim 4, wherein the optical ports are arranged in a predetermined pattern.

6. The antenna of claim 5, wherein the predetermined pattern of optical ports includes an inner circle located around the central feed.

7. The antenna of claim 6, wherein the predetermined pattern of optical ports includes a multiplicity of radial spokes located around the inner circle.

8. The antenna of claim 5, wherein the predetermined pattern of optical ports includes a multiplicity of radial spokes located around the central feed.

9. The antenna of claim 5, wherein the photonic source means includes a separate optical fiber coupled to each of the optical ports.

10. The antenna of claim 5, wherein the photonic source means includes selectively operable LEDs each coupled to one or more optical ports.

11. The antenna of claim 5, wherein the photonic source means includes a selectively operable LED located at each optical ports.

12. The antenna of claim 5, wherein the predetermined pattern of optical ports cause the photonic source means to form a multiplicity of separate conductive columns through the semiconductor medium between the conductive plates.

13. The antenna of claim 12, wherein the antenna is intended to operate at frequencies having a minimum wavelength, and further wherein the conductive columns are separated by less than one-half of the minimum wavelength.

14. A steerable antenna, comprising:

a dielectric cylinder having a top and a bottom surface;

a first metallized layer substantially covering said bottom surface and a second metallized layer covering at least a portion of said top surface and having a predetermined pattern of ports formed therein;

switch means associated with said predetermined pattern of ports for selectively connecting said first metallized layer to said second metallized layer, said switch means forming a conductive barrier therebetween;

switch activating means connected to each of said switch means for selectively turning said switch means on and off; and feed means disposed proximate a central region of at least one of said top and said bottom surfaces and adapted to couple a radio frequency (RF) signal to and from said steerable antenna;

whereby upon selective activation of said switch means, a steerable antenna structure is formed in said dielectric cylinder by said conductive regions and said RF feed.

15. The steerable antenna as recited in claim 14, wherein said dielectric cylinder is a semiconductor.

16. The steerable antenna as recited in claim 15, wherein said semiconductor comprises one from the group of materials: monolithic intrinsic silicon, gallium arsenide, indium phosphide, and other semiconductor material having a bulk resistance of approximately 5000 ohm-cm.

17. The steerable antenna as recited in claim 15, wherein said switch means comprises a doped region in said semiconductor.

18. The steerable antenna as recited in claim 14, wherein said switch activation means comprises at least one activating light source from the group of LED diodes and lasers, wherein said activating light source is applied to at least one of said perforations, thereby making a region in said dielectric cylinder therebeneath electrically conductive.

19. The steerable antenna as recited in claim 14, wherein said feed means comprises is passive feed means comprising a probe.

20. The steerable antenna as recited in claim 14, wherein said feed means comprises active feed means comprising resonator means proximate said dielectric cylinder.

21. A stacked, steerable horn antenna assembly formed from a plurality of steerable antennas, each comprising:

a dielectric cylinder having a top and a bottom surface;

a first metallized layer substantially covering said bottom surface and a second metallized layer covering at least a portion of said top surface and having a predetermined pattern of ports formed therein;

switch means associated with said predetermined pattern of ports for selectively connecting said first metallized layer to said second metallized layer, said switch means forming a conductive barrier therebetween;

switch activating means connected to each of said switch means for selectively turning said switch means on and off;

feed means disposed proximate a central region of at least one of said top and said bottom surfaces to couple a radio frequency (RF) signal to said steerable horn antenna assembly;

whereby upon selective activation of said switch means, a steerable antenna structure is formed in said dielectric cylinder by said conductive barrier and said radio frequency feed means, said plurality of steerable antennas being stacked substantially coaxially, one above another, each of said plurality of steerable antennas being independently operable with regard to frequency and directionality.

22. The stacked, steerable antenna assembly formed from a plurality of steerable antennas as recited in claim 21, wherein said antenna assembly comprises two steerable antennas configured for full duplex operation, a first of said two steerable antennas for receiving a radio frequency (RF) signal in a first, predetermined band and a second of said two steerable antennas for transmitting an RF signal in a second predetermined band.

23. The stacked, steerable antenna assembly formed from a plurality of steerable antennas as recited in claim 21, wherein said antenna assembly comprises two steerable antennas, a first of said two steerable antennas receiving a radio frequency (RF) signal in a first, predetermined band and a second of said two steerable horn antennas receiving an RF signal in a second predetermined band.

* * * * *